United States Patent [19]

Mayo

[11] Patent Number: 4,559,809

[45] Date of Patent: Dec. 24, 1985

[54] PROCESS OF TESTING BLOW-OUT PREVENTER WITHOUT PULLING THE WEAR BUSHING

[76] Inventor: John H. Mayo, 404 Alonda Dr., Lafayette, La. 70503

[21] Appl. No.: 632,021

[22] Filed: Jul. 18, 1984

[51] Int. Cl.[4] ..... G01M 3/28

[52] U.S. Cl. ..... 73/40.5 R; 73/49.1

[58] Field of Search ..... 73/40.5 R, 49.1, 49.6, 73/151

[56] References Cited

U.S. PATENT DOCUMENTS

| | | | |
|---|---|---|---|
| 3,165,919 | 1/1965 | Loomis | 73/40.5 R |
| 3,420,095 | 1/1969 | Brown et al. | 73/40.5 R |
| 4,152,924 | 5/1979 | Mayo | 73/40.5 R |
| 4,373,380 | 2/1983 | Mayo | 73/40.5 R |

*Primary Examiner*—Howard A. Birmiel

*Attorney, Agent, or Firm*—Kimmel, Crowell & Weaver

[57] ABSTRACT

To avoid the excessive cost and time required to pull the wear bushing from a sub-sea well head in deep water to enable frequent periodic testing of the blow-out preventer, a casing integrity test tool is assembled to a wear bushing running and retrieving tool and this assembly is run into the well until it lands on a seating surface of the wear bushing. A dart for delivering tool energizing pressurized fluid is dropped through the drill pipe and pressurized to a pressure above the pressure being employed to test the blow-out preventer. While maintaining pressure on the drill pipe and dart, the blow-out preventer is tested except for the blind rams. After completion of the testing, pressure is relieved on the drill pipe, the dart is retrieved, and dry string retrieval of the test tool assembly is then carried out.

4 Claims, 3 Drawing Figures

PROCESS OF TESTING BLOW-OUT PREVENTER WITHOUT PULLING THE WEAR BUSHING

BACKGROUND OF THE INVENTION

In sub-sea well drilling operations, it has been customary to test the blow-out preventers (BOPs) once a week. This is done by pulling the wear bushing (sometimes called "bore protector") from the sub-sea well head prior to running a plug tester into the well.

Part of the reason behind pulling the wear bushing is to check the extent of wear on the bushing bore to estimate the amount of wear that could exist in the bore of the smallest diameter well casing below the wear bushing which is suspended from the topmost casing hanger. If the wear bushing bore is worn, this indicates that the same degree of wear or possibly more wear could exist in the bore of the well casing immediately below the wear bushing. Excessive wear of this nature anywhere in the well below the BOP can result in a blow-out at the point where the drill pipe string has worn a groove through, or nearly through, the casing wall.

The object of the present invention is to provide a method for periodically testing the BOP without the necessity for pulling the wear bushing, thereby saving considerable time and cost compared to the prior art procedure. The present process is particularly advantageous in the deeper depths of the sea in which off-shore wells are now being drilled. Furthermore, in the prior art testing of the BOPs, without pulling the wear bushing, there is no reliable way of determining the degree of wear on pipe or casing below the first casing hanger.

In accordance with the essence of the present invention, a special test tool assembly is made up and is run into the well to land on a tapered seating surface of the wear bushing. After this landing, a dart for delivering energizing pressurized fluid to the test tool is dropped through the drill pipe. The test tool is then pressurized or energized to a pressure well above the pressure to be employed for testing the BOP, usually one thousand pounds above the BOP test pressure. While maintaining this energizing pressure on the test tool, the BOP can be tested except for the blind rams. After completing the testing of the BOP, pressure on the drill pipe is bled off, the dart is retrieved and this allows dry string retrieval of the test tool assembly to the floor of the rig. The test tool used in the process is of the type disclosed in U.S. Pat. No. 4,373,380, issued Feb. 15, 1983, to Mayo.

When the test tool has been retrieved, the thin metal lips of its seals are inspected for bulging or deformity. This gives a direct indication of the degree of wear in the bore of the well casing below the first casing hanger and wear bushing. The permanent deformation of the metal lips of the test tool seal is caused by these lips being forced outwardly into any wear groove or recess which may exist in the well casing when the tool is energized by pressure fluid delivered through the dart.

Other features and advantages of the invention will become apparent to those skilled in the art during the course of the following description.

DETAILED DESCRIPTION

Figure 1A:
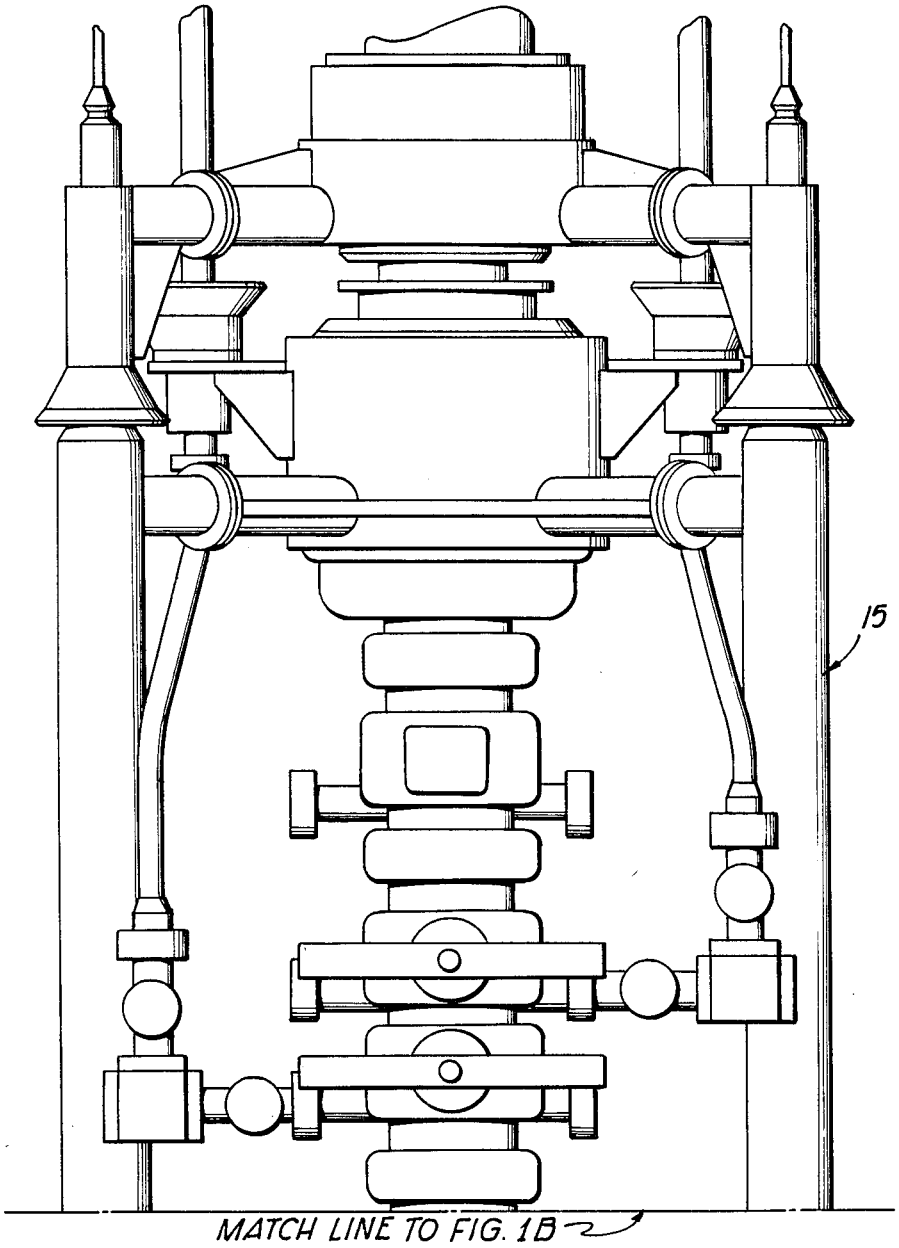
FIGS. 1A and 1B, when registered on their match lines, form a fragmentary side elevation, partly in vertical cross section, of a sub-sea well head, external support structure on the sea floor and blow-out preventer stack.
Figure 1B:
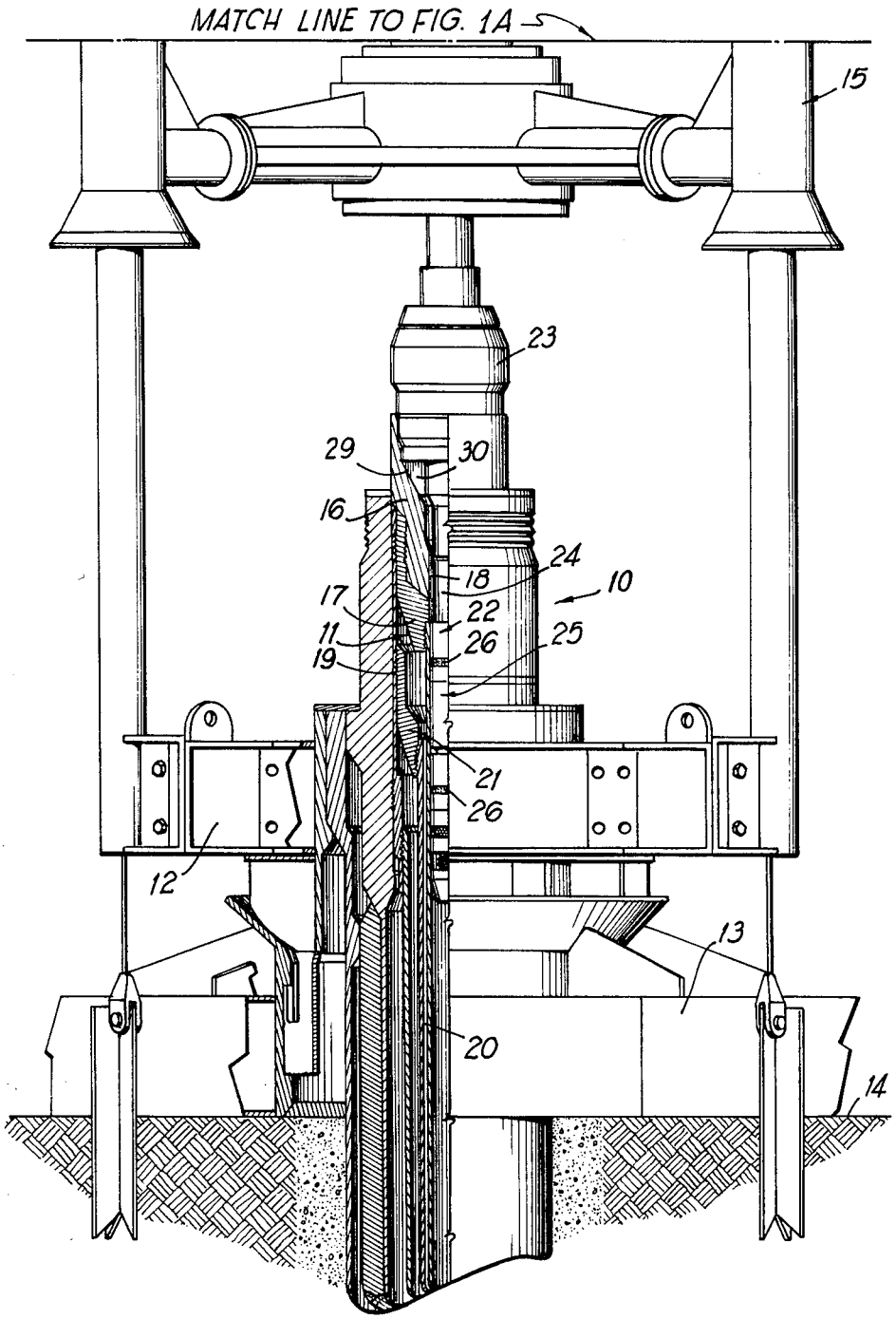

Referring to the drawings in detail wherein like numerals designate like parts, a sub-sea well head 10 includes a well head housing 11 held in a permanent guide structure 12 above an external support frame 13 anchored to the sea floor 14. A conventional BOP stack 15 extends above the guide structure 12 as depicted in FIGS. 1A and 1B. The customary wear bushing 16 (sometimes called "bore protector") is contained within the top of well head housing 11 immediately above the first or topmost casing hanger 17 of the sub-sea well head.

Figure 2:
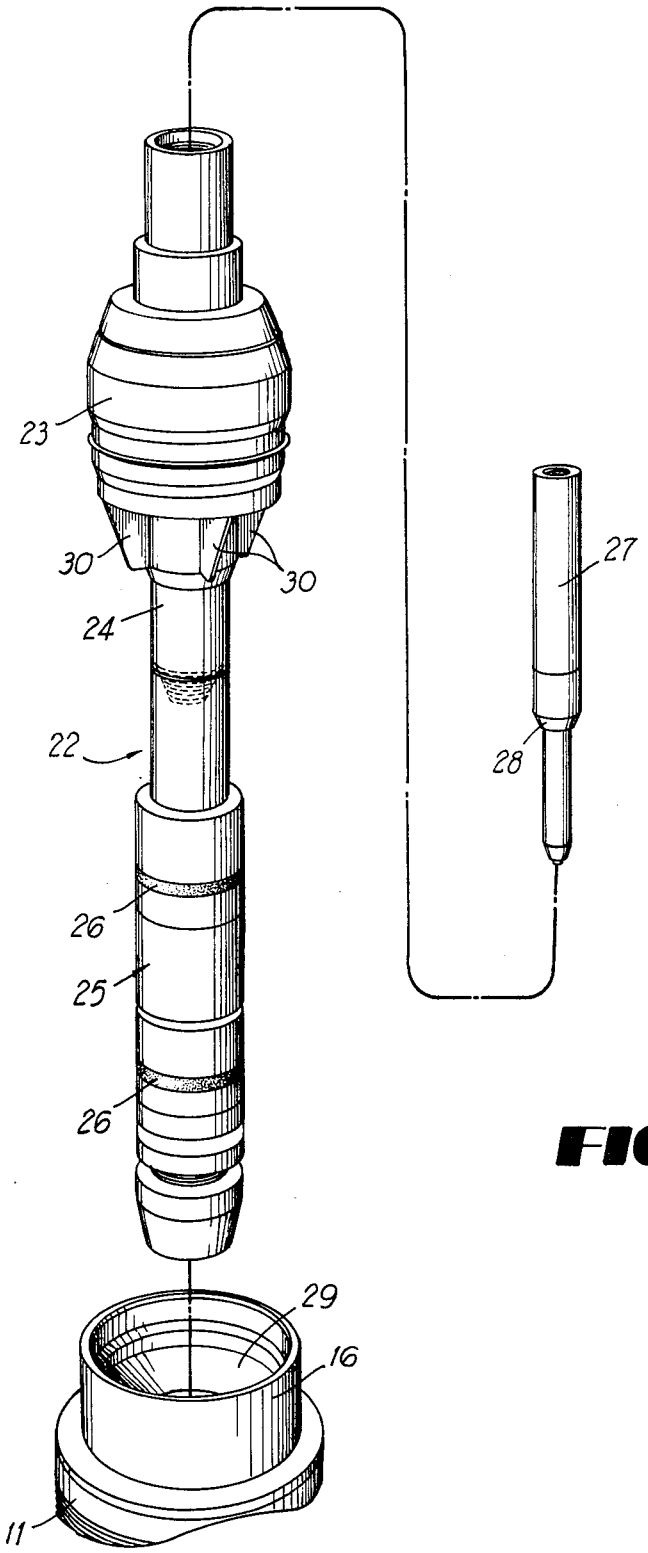
FIG. 2 is an exploded perspective view showing a test tool assembly, fluid delivery dart, and well head wear bushing employed in the practice of the process.

The cylindrical bore 18 of the wear bushing 16 is coaxially aligned with the bore of the innermost well casing 19 suspended from the casing hanger 17. The successively larger diameter well casings, such as the casing 20, are suspended from additional casing hangers below the hanger 17, such as the hanger 21. The description and illustration of the sub-sea well structure is conventional and need not be dealt with in greater detail to enable a full understanding of the invention. As described previously, the periodic testing of the BOP 15, such as once a week, is usually accomplished by pulling the wear bushing 16 prior to running a plug tester into the well. This is time-consuming, costly and tedious, particularly in deep water where offshore wells are now being drilled. The present invention, about to be described, obviates the costly pulling and subsequent replacement of the wear bushing 16 and allows the wear bushing to remain in place during testing of the BOP by a special tool assembly 22 shown separately in FIG. 2 and shown installed in the casing 19 which being seated on the wear bushing 16 in FIG. 1B. In the process according to the present invention, not only is the testing of the BOP rendered simpler and much less time-consuming but additional valuable information concerning the condition of the well below the casing hanger 17 is enabled. Such information heretofore has not been attainable under prior art methods of testing.

The special test tool assembly 22 employed in the new process comprises a seating head 23 similar or identical to the conventional running and retrieving tool for the wear bushing 16. Coupled to the bottom of the seating head 23 by a suitable length of spacer pipe 24 is a test tool 25 of the type disclosed in U.S. Pat. No. 4,373,380. The test tool 25 has a pair of axially spaced elastic ring seals 26 contained by metallic retainer rings having thin lips which overlap the exterior of the elastic ring seals at their tops and bottoms.

The seals 26 are pressurized or energized with fluid under pressure delivered by a dart 27 which is dropped through the drilling pipe and into a bore of the test tool 25 until a tapered surface 28 of the dart 27 lands on a matching tapered seating surface in the tool 25 as fully shown in the referenced application.

The wear bushing 16 has an internal tapered surface 29 which receives and seats tapered webs 30 provided on the lower end of the seating head 23 of the tool assembly 22. FIG. 1B shows the arrangement after the special test tool assembly 22 has landed on the wear bushing 16 and the tool 25 is positioned in the bore of the smallest casing 19. No other apparatus is involved in the practice of the method.

Following the dropping of the dart 27 into the tool 25 through the drill pipe, the testing of the BOP stack and simultaneous testing of the condition of wear in the bore of the casing 19 takes place as follows:

The drill pipe is pressured up to about 1000 pounds above the desired test pressure to be applied to the BOP 15. This drill pipe pressure is delivered through the dart 27 to the tool 25 exactly as disclosed in U.S. Pat. No. 4,373,380 to energize or radially expand the elastic seals 26 against the bore of the casing 19. While holding this degree of pressure on the drill pipe, the BOP is tested except for the blind rams. If a discernible wear groove or recess exists in the bore of casing 19 as a result of drilling pipe abrasion, the thin metal lips of the elastic seal retainer rings on the test tool 25 will be forced outwardly into the wear groove or recess due to the heavy pressure exerted on these lips by the compressed and expanded elastic seal 26 or seals. Such deformation or bulging of the metal lips is permanent and provides a permanent visual indication of the existence of and the degree of the wear which may be present in the bore of the casing 19. The test tool 25 of the present application has a mode of operation substantially identical to the mode of operation of the test tool in U.S. Pat. No. 4,373,380.

Upon completion of the testing of the BOP while the wear bushing 16 remains in place, and the simultaneous testing of the integrity of the casing 19, as described, the fluid pressure on the drill pipe is bled off and the dart 27 is retrieved up to the floor of the rig by a retrieval line which is run into the well. After this, the test tool assembly 22 can be retrieved through a dry string up to the floor of the rig. The thin metal lips of the elastic seal containment rings on the tool 25 are inspected for deformities, and the extent of the metal lip deformity, if any, directly indicates the degree of seriousness of the wear on the well casing below the wear bushing 16 and first casing hanger 17. This completes the testing process according to the invention. The deformed metal lips of the elastic seal containment rings on the tool 25 can be reconformed for further usage in subsequent testing or the seal containment rings can be replaced, if desired.

The test process is simpler and much less costly than the prior art process of testing BOPs involving pulling the wear bushing. The new test process is also more versatile and produces additional valuable test results pertaining to the condition of wear on the well casing below the wear bushing, not heretofore obtainable in the prior art.

While the foregoing description and drawings disclose a practical and satisfactory way to practice the method, it should be understood that certain variations in the method and the apparatus for carrying it out are contemplated. For example, the wear bushing running and retrieving tool 23 forming a seating head may simply be a dummy device formed in the required shape but not adapted to be used for running and retrieving a wear bushing. Also, the spacer pipe 24 can have its length varied to change the location of the test tool 25 inside of the well casing 19. More importantly, the seating head 23 can be suspended from points other than the tapered surface 29 of wear bushing 16. For example, the seating head 23 could be suspended from a set of rams in the BOP or from some other point. The tool assembly could, for example, be suspended on a hydril.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A process of testing a blow-out preventer and simultaneously testing well casing below the wear bushing for wear without pulling the wear bushing, comprising running a test tool assembly having spaced elastic ring seals and metal seal containment rings into a well and landing the assembly on a support surface of the wear bushing with the test tool extending into the bore of the well casing immediately below the wear bushing, dropping a fluid delivery dart through drill pipe into the test tool assembly until the dart is seated on an internal support surface of the test tool, pressurizing the drill pipe and dart to a pressure above the test pressure required to test the blow-out preventer and maintaining such pressure until the testing of the blow-out preventer is completed, relieving pressure on the drill pipe, retrieving the dart and test tool assembly, and then inspecting the condition of the metal seal containment rings of the test tool to determine the existence of and degree of wear in the bore of the well casing.

2. The process of claim 1, and the additional step of preassembling a wear bushing running and retrieving tool with a fluid pressure activated casing bore test tool prior to said running of the test tool assembly into the well.

3. A process of testing a well blow-out preventer having blind rams without pulling the wear bushing contained in a sub-sea well head housing, comprising making up a test tool having an upper end seating head adapted to rest on a supporting surface of the wear bushing and also having a lower end test tool portion equipped with fluid pressure activated elastic ring seals and metal ring seal containment rings, running said test tool into the well until said seating head lands on said supporting surface of the wear bushing, pressurizing the test tool with fluid under pressure in the drilling pipe and thereby activating said elastic ring seals so that they expand radially against the bore of well casing below the wear bushing, testing the blow-out preventer except for the blind rams thereof while continuing said pressurizing of the test tool, discontinuing said pressurizing and retrieving the test tool from the well, and then inspecting said metal ring seal containment rings of the test tool for deformation indicative of the presence of a wear groove or recess in the well casing bore below the wear bushing caused by drill pipe abrasion.

4. A process of testing a well blow-out preventer without pulling the wear bushing contained in a sub-sea well head housing, comprising the steps of running a test tool assembly having pressure deformable seal retainer elements into the well and landing it on a support surface, dropping a dart through the well drill pipe into the test tool assembly and pressurizing the drill pipe to approximately 1000 pounds above the blow-out preventer test pressure, testing the blow-out preventer while maintaining said pressurization of the drill pipe, bleeding off the pressure on the drill pipe after completing testing of the blow-out preventer, retrieving the dart from the well, retrieving the test tool assembly, and inspecting said pressure deformable seal retainer elements of the test tool assembly after its retrieval to obtain an indication of the condition of wear in the bore of well casing below the wear bushing.

* * * * *